US006390801B1

(12) United States Patent
Smith

(10) Patent No.: US 6,390,801 B1
(45) Date of Patent: May 21, 2002

(54) TEXTURING TOOL

(76) Inventor: Steven Dale Smith, P.O. Box 1506, Centralia, WA (US) 98531

( * ) Notice: Subject to any disclaimer, the term of this patent is extended or adjusted under 35 U.S.C. 154(b) by 0 days.

(21) Appl. No.: 09/003,556

(22) Filed: Jan. 6, 1998

(51) Int. Cl.[7] ..... B28B 1/30
(52) U.S. Cl. ..... 425/458; 15/235.4
(58) Field of Search ..... 425/87, 318, 385, 425/458; 15/104.001, 104.05, 104.16, 105.5, 210.5, 235.3, 235.4; 101/127; D7/682; D15/123; 241/169.2

(56) References Cited

U.S. PATENT DOCUMENTS

| | | | | | |
|---|---|---|---|---|---|
| D43,064 | S | * | 9/1912 | Streeter | D7/682 |
| 1,700,079 | A | | 1/1929 | Sakowich | |
| 1,741,698 | A | | 12/1929 | Hampson | |
| 1,789,627 | A | | 1/1931 | Hill | |
| 1,800,653 | A | * | 4/1931 | Morris | |
| 1,908,237 | A | | 5/1933 | Hampson | |
| D164,380 | S | * | 8/1951 | Packer | D7/682 |
| 2,811,767 | A | * | 11/1957 | Dufford | 425/458 |
| 3,142,082 | A | | 7/1964 | Harwood | |
| 4,030,414 | A | | 6/1977 | McGuire | |
| 4,131,406 | A | * | 12/1978 | Fresquez | 425/385 |
| 4,135,840 | A | * | 1/1979 | Puccini et al. | |
| 4,838,728 | A | * | 6/1989 | McKeever | 425/458 |
| 5,000,671 | A | | 3/1991 | Nolte | |
| 5,302,205 | A | | 4/1994 | Priddy | |
| 5,887,846 | A | * | 3/1999 | Hupp | 425/458 |

FOREIGN PATENT DOCUMENTS

| | | | | |
|---|---|---|---|---|
| FR | 817801 | * | 9/1937 | 241/169.2 |
| FR | 925293 | * | 8/1947 | 241/169.2 |

* cited by examiner

*Primary Examiner*—Nam Nguyen
*Assistant Examiner*—Joseph Leyson

(57) ABSTRACT

A manual tool for imparting a textured surface to a wall, ceiling or other rigid surface. The tool comprises a rigid, flat, thin tool blade, having a plurality of holes irregularly distributed thereon. The holes are preferably irregular in shape and have major dimension in the range 0.5 to 1.25 inch. A handle for grasping and manipulating the tool is attached to a first side of the tool blade. A rectangular blade version of the tool is used for texturing corner areas, and a circular blade version of the tool is used for non-corner areas. In use, joint compound is applied to a second, opposite side of the blade and then daubed onto a surface area. The tool is then repeatedly pressed against and withdrawn from the area until a desired surface texture is achieved, the texture becoming progressively finer with each repetition. After a drying period, the coated, textured surface is leveled by moving a leveling blade across the surface.

2 Claims, 6 Drawing Sheets

TEXTURING TOOL

CROSS REFERENCE TO RELATED APPLICATIONS

Not applicable.

STATEMENT REGARDING FEDERALLY APPROVED RESEARCH OR DEVELOPMENT

Not applicable.

BACKGROUND OF THE INVENTION

1. Field of the Invention

The present invention relates generally to tools for applying ornamental designs to walls and ceilings, and more particularly to tools for imparting a texture to the surfaces thereof.

2. Background Art

Several advantages are derived from imparting a textured surface to plaster and plasterboard surfaces of walls and ceilings: the irregularities in a textured surface are generally considered to enhance the appearance, especially when they include ornamental patterns; reflective glare from interior and exterior light sources is reduced; and some degree of sound deadening may also be achieved. For large scale texturing operations, such as when texturing several rooms in a new or remodeled building, the method of choice has been to spray joint compound onto the walls and/or ceilings from mechanical spray apparatus. The spray method required a significant amount of time and labor for taping and covering the windows, doors, and floors, as well as for clean up after the spraying was completed, which made it cumbersome and uneconomical for relatively small texturing jobs, such as texturing the walls of a single bedroom or office. Prior to my invention, such small texturing operations were performed with a variety of manual tools. Most commonly, for small texturing operations, joint compound was manually applied to wall and/or ceiling surfaces with a hand trowel to create a uniform, adhered layer of compound. The layer of compound was then textured manually by pressing against the layer with a hand sponge, crumpled-up newspaper, or with some specialized hand tool. An example of the latter was the manual texturing, mottling and blending tool of T. D. Hill, U.S. Pat. No. 1,789,627, which had interchangeable, soft, flexible, rubber layers embossed with a design for removing plastic material—e.g., joint compound—from a surface to create a design thereon. The texturing technique described by Hill required reciprocal motion of the tool against the plastic material surface, at the same time executing a series of forward and back, upward and downward wrist movements, thereby separating the wet top coat or coats from an underlying dry ground coat. Some degree of skill was necessary, however, to achieve a pleasing and uniform texture in this manner, as was the case with other manual texturing tools prior to my invention. Unlike my tool, which both applies and textures a surface coat, Hill's and other prior art manual texturing methods required separate tools and steps for applying, and then later, texturing a surface coat.

OBJECTS AND ADVANTAGES

There remains a need, therefore, for a manual texturing tool that is convenient for texturing small areas of interior walls and ceilings; a tool that even an unskilled novice may use to achieve an attractive and uniform surface texture with minimal time and effort; simple and sturdy in construction, and inexpensive to manufacture.

SUMMARY OF THE INVENTION

My texturing tool comprises a rigid, flat, thin tool blade, which may be made of plastic or any other suitable material. The tool blade has a plurality of holes irregularly distributed thereon. The holes may be of any shape and are preferably irregularly shaped. In a first embodiment of my tool, the blade is circular in plan form, and is intended for texturing the surface of any portion of an interior wall or ceiling except portions thereof that are adjacent another wall or ceiling. In a second embodiment of my tool, the blade is rectangular in plan view, and is intended for texturing the surface of a wall or ceiling that is immediately adjacent an adjoining wall or ceiling. The holes preferably have major dimension in the range of one-half to one inch. My tool further comprises a handle, attached to a first side of the blade. The handle is preferably elongated and cylindrically-shaped, having a first end attached to a central portion of the blade, and having an opposite, free end for grasping and manipulating the tool. In use, joint compound is applied to a second, opposite side of the blade and daubed onto a surface area of a wall or ceiling. The tool is then repeatedly daubed against and withdrawn from the layer until the desired surface texture is achieved, the texture gradually changing from rough to fine the more the process is repeated. After a period of drying, a flat, leveling blade is then drawn over the textured surface to remove any undesired peaks or hills therein.

BRIEF DESCRIPTION OF THE DRAWINGS

The numerals denote corresponding parts throughout the figures.

DETAILED DESCRIPTION OF THE ILLUSTRATED EMBODIMENT

Figure 1:
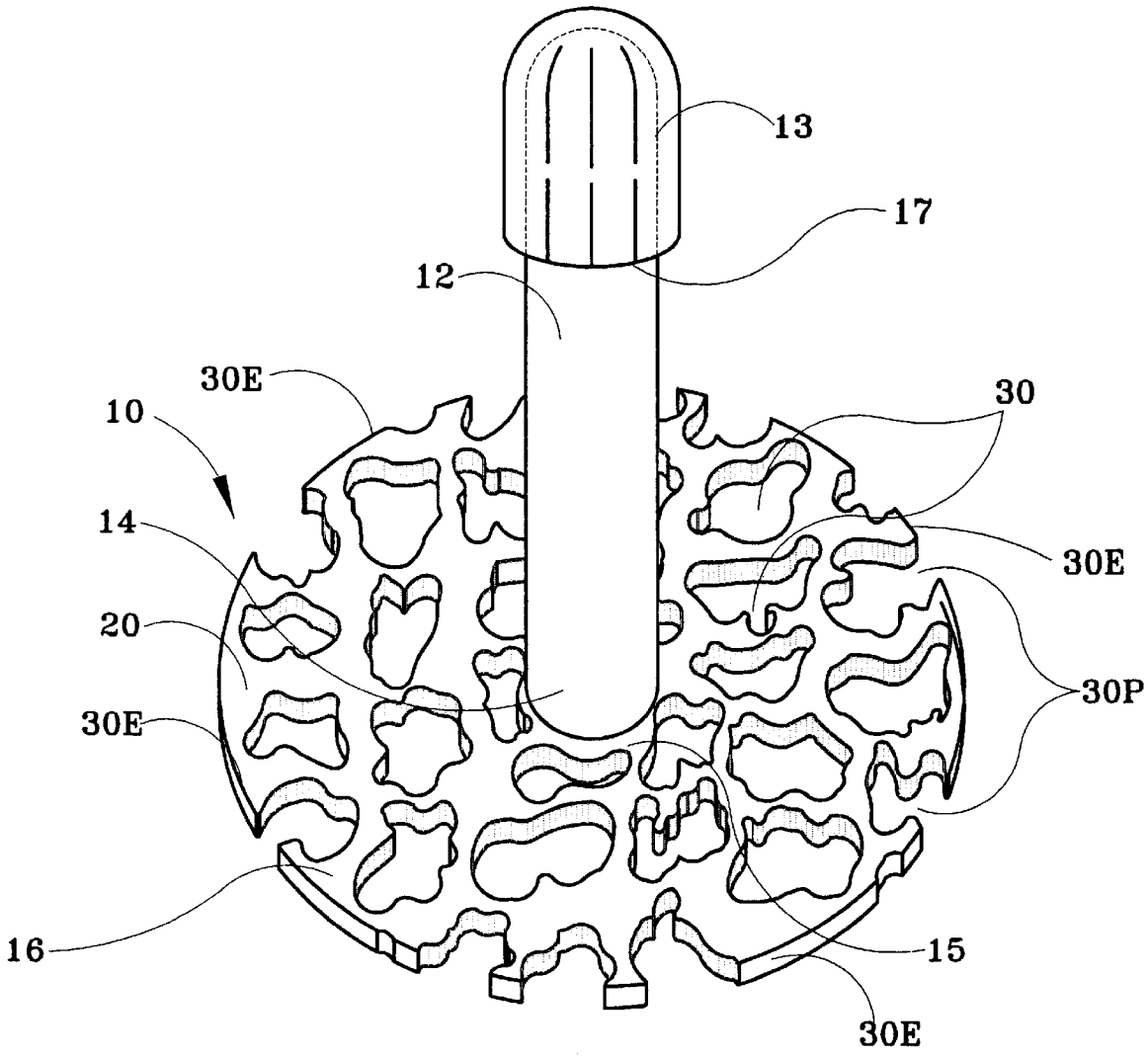
FIG. 1 is a perspective view of a first embodiment of my texturing tool.
Figure 2:
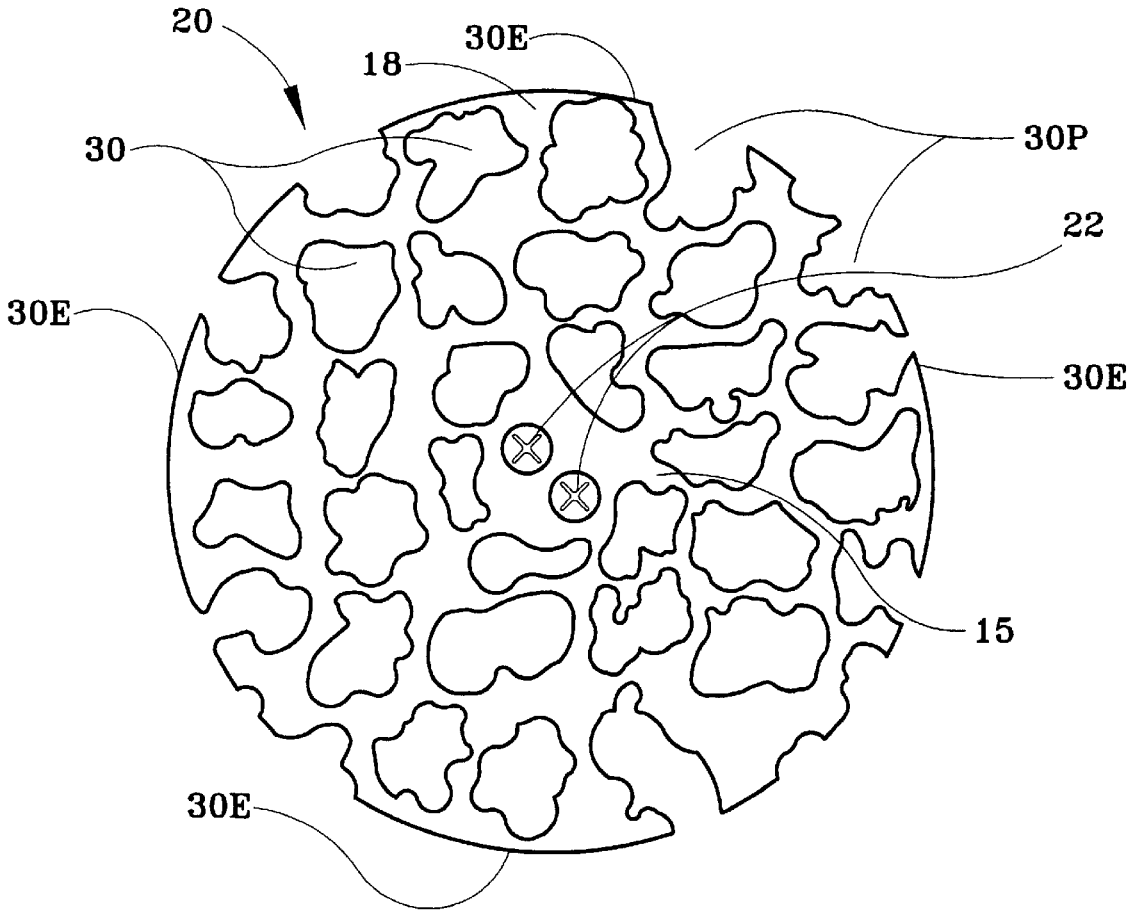
FIG. 2 is a bottom plan view of the tool blade thereof.

Referring now to FIGS. 1 and 2, a first embodiment of my texturing tool is depicted, denoted generally by the numeral 10, and showing an elongated, cylindrically-shaped handle 12 having a first end 14 attached to a central portion 15 of a first side 16 of a circular blade 20. The handle 12 is preferably made of wood or plastic, and is preferably attached to the blade 20 by countersunk screws 22 that extend through the blade 20 from a second, opposite side 18 thereof. The handle 12 has a second opposite end 17 for grasping and manipulating the tool 10, which opposite end 17 extends away from the blade 20 in a direction normal to a plane that includes the blade 20. Optionally, the handle 12 may include a hand grip in the form of a rubber sleeve 13 drawn over the second end 17.

The circular blade 20 preferably has diameter of 6.5 inches, more or less, to fit inside a standard, cylindrical gallon container. The blade 20 has a plurality of irregularly distributed holes 30, which may be of any shape, such as square, circular, elliptical, et cetera, but preferably are irregularly shaped, as shown. As shown in FIGS. 1–4, the spacing of adjacent holes 30 is irregular. The major dimension of the holes 30 is preferably in the range one-half inch to one and one-quarter inches. The thickness of the blade 20 itself is preferably in the range one-eighth to one-half inch, and for most purposes is optimally one-quarter inch. The blade 20 may be made of wood or metal, but plastic—especially LEXAN® plastic sheet—is preferred. Most of the holes 30 are cut out of the interior part of the blade 20, but some of the holes 30P are cut out of the periphery. Preferably, however, for at least four peripheral areas, spaced-apart at locations corresponding to the 3, 6, 9 and 12 o'clock locations on a clock face, there are continuous, peripheral edges 30E uninterrupted by cutouts for holes 30. This first embodiment of my tool 10 is intended for texturing surface areas of walls and ceilings that are not immediately adjacent to another wall or ceiling.

Figure 3:
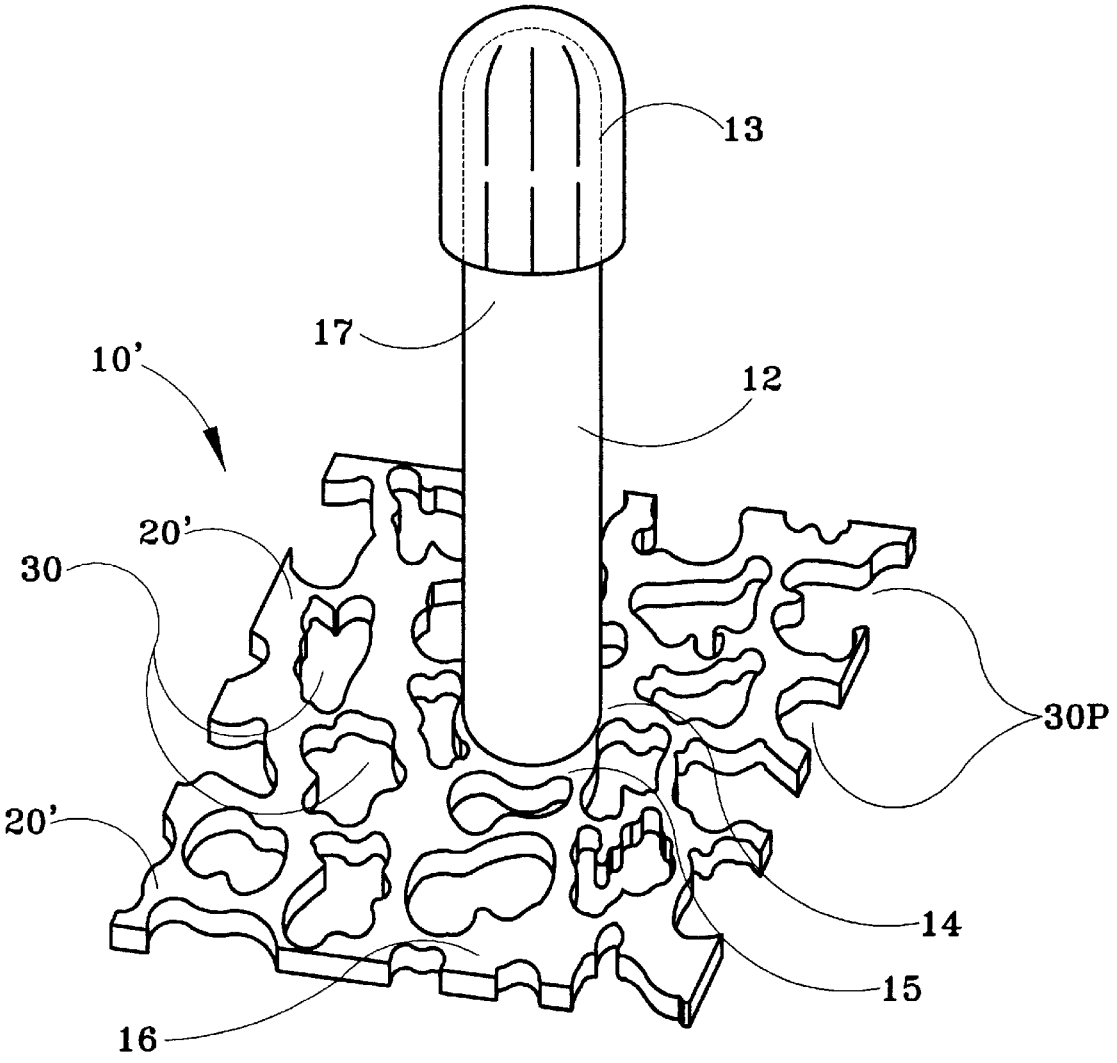
FIG. 3 is a perspective view of a second embodiment of my tool.
Figure 4:
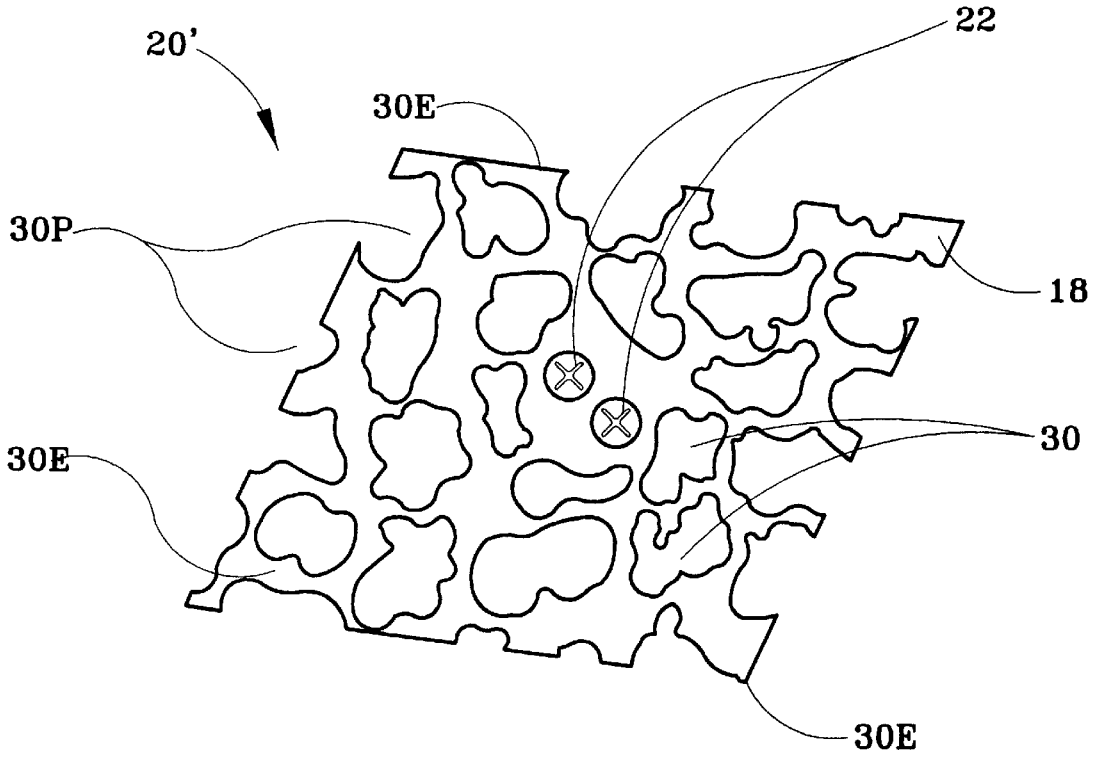
FIG. 4 is a bottom plan view of the tool blade thereof.

FIGS. 3 and 4 depict a second embodiment of my tool 10' having the same parts and features as the first embodiment, with the single exception that the blade 20' thereof is rectangular in plan view. This second embodiment is intended for texturing a surface area of a wall or ceiling that is immediately adjacent, and perpendicular to, another wall or ceiling, thereby forming a corner. Preferably, the blade 20' is square in plan view, and three inches by three inch inches, more or less.

Figure 5:
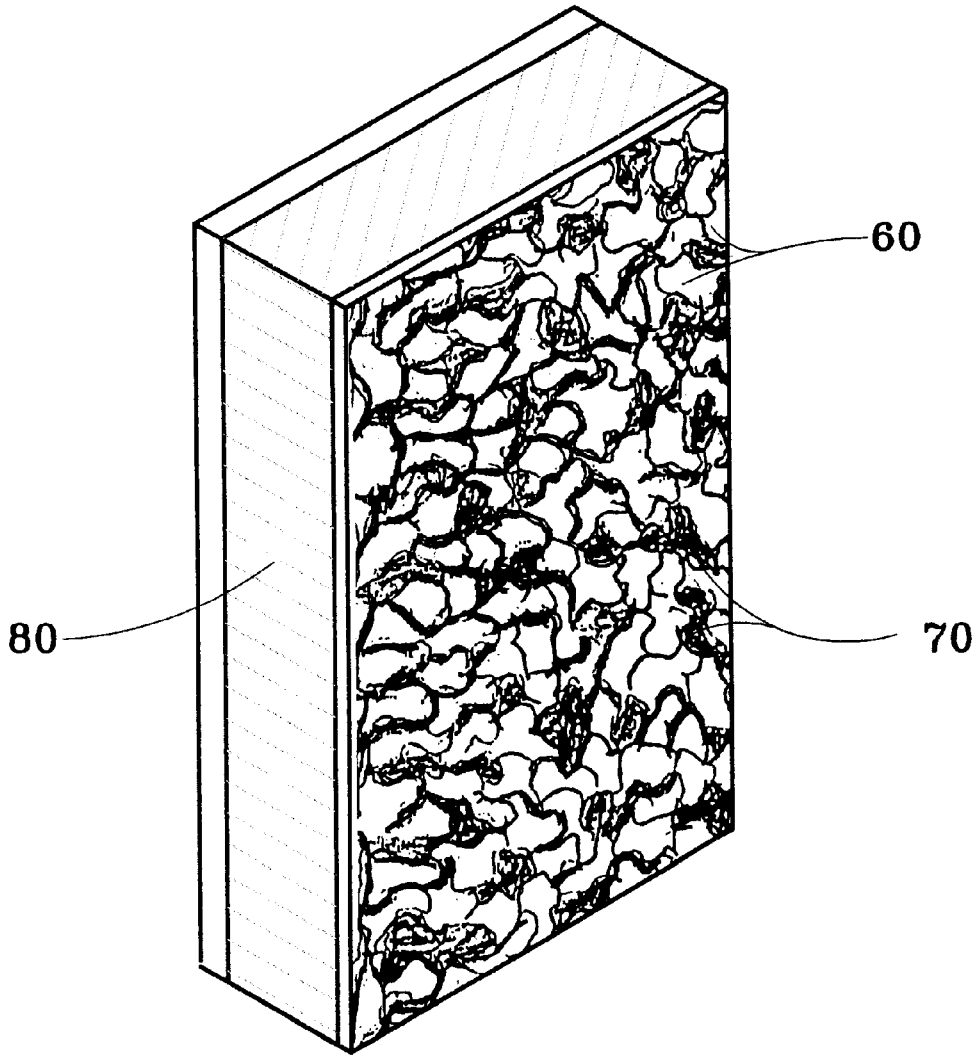
FIG. 5 is an enlarged perspective view of the surface of a layer of compound applied by my tool to plasterboard 80 (shown in fragmentary cross-section) and showing the relatively coarse texture achieved after only one or two applications and withdrawals of the tool.
Figure 6:
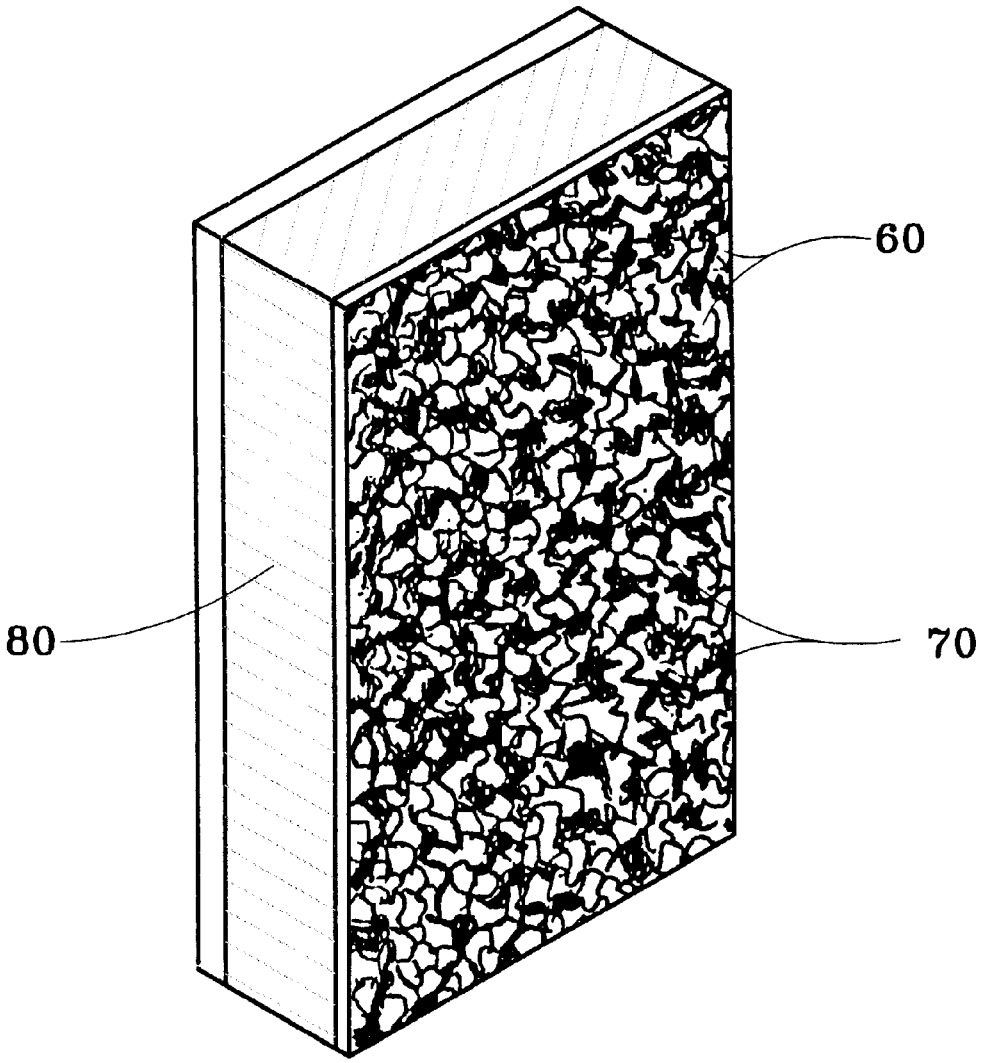
FIG. 6 is a perspective view of the same surface area shown in FIG. 5 after several more applications and withdrawals of the tool to the same surface area, showing the relatively fine surface texture achieved thereby.

Texturing of a wall or ceiling proceeds as follows. An open container of joint compound (not shown) is prepared, adding water thereto if necessary to obtain the desired consistency. Preferably, the container is a hollow, cylindrical, one gallon container. The handle 12 of the first embodiment of the tool (i.e., having a circular blade 20) is grasped and compound is layered onto the second side 18 of the blade 20, such as by dipping the second side 18 flush into the compound in the container, provided that care is taken that no compound enters into any of the holes 30. The compound is then daubed onto a first, non-corner surface area of the wall e.g., plasterboard wall 80 that is, a surface area that is not adjacent another wall or ceiling. The second side 18 of the blade 20 is again daubed against the area, thereby filling the holes 30, and then withdrawn from the area, whereby the holes 30 are then more or less emptied of compound. Thus far, the procedure produces a coarse surface texture comprising relatively large hills 60 and valleys 70, as shown, for example, in FIG. 5. If a finer texture is desired, the second side 18 of the blade 20 is repeatedly daubed against the area and then withdrawn from the area, which results in progressively smaller hills 60 and valleys 70 and finer surface texture, as shown, for example, in FIG. 6. The blade 20 is again dipped into the container of compound, and compound is then daubed onto a second, adjacent non-corner surface area, followed by such repeated daubing to, and withdrawal from, said area as may be necessary, if any, to achieve the desired fineness of surface texture. Thereafter, the dipping and daubing actions are repeated as to all uncoated adjacent, non-corner areas, during which period of time the applied surface coat is gradually drying. After a period of drying, which varies depending on ambient temperature, humidity in the air, and other factors, the peaks of excessively large hills are removed by drawing a leveling blade across them—for example, the blade of a six inch taping knife.

When texturing corner areas of walls and ceilings, the same procedure is used, except with the second embodiment of the tool (i.e., having a rectangular blade 20'). In this manner, walls and ceilings may be textured uniformly and rapidly, with minimal time and effort, a small drop cloth and a few wiping rags being all that is necessary for site preparation and cleanup.

It will be appreciated that modifications can be made to the exact form of the present invention without departing from the scope thereof. For example, my method for using my texturing tool can impart texture to concrete patching adhesives, such as, for example, are commonly applied to exterior brick or concrete walls. Accordingly, the terms "joint compound" and "compound" will be understood to include all such interior and exterior surface coating materials, even those that are epoxy or plastic based. It is accordingly intended that the disclosure be taken as illustrative only and not limiting in scope, and that the scope of the invention be defined by the following claims.

I claim:

1. A texturing tool for applying joint compound to a wall, ceiling or other rigid surface, comprising a rigid, flat, thin tool blade, and a handle attached to a first side of the tool blade, said tool blade having a plurality of irregularly distributed holes, each of said holes extending through the tool blade from the first side to an opposite, second side thereof, wherein the holes are irregularly-shaped and are distributed such that at least four, peripheral edge portions of the tool blade each include a continuous, uninterrupted peripheral edge, said edge portions being spaced apart and joined by peripheral edge portions of the tool blade that have interrupted, peripheral edges, the spacing of adjacent holes being irregular.

2. A texturing tool for applying joint compound to a wall, ceiling or other rigid surface, comprising a rigid, flat, thin tool blade, and a handle attached to a first side of the tool blade, said tool blade having a plurality of irregularly distributed holes, each of said holes extending through the tool blade from the first side to an opposite, second side thereof; wherein, the tool blade is circular in plan view, the holes have major dimension in the range 0.5 inch to 1.25 inch, the thickness of the tool blade is in the range one-eighth inch to one-half inch, the handle is elongated and substantially cylindrical in shape and has a first end attached to a central portion of the first side of the tool blade and an opposite, second end that extends away from the tool blade in a direction normal to a plane that includes the tool blade, and the holes are distributed such that at least four, peripheral edge portions of the tool blade each include a continuous, uninterrupted peripheral edge, said edge portions being spaced apart and joined by peripheral edge portions of the tool blade that have interrupted, peripheral edges, the spacing of adjacent holes being irregular.

* * * * *